US009366414B2

(12) United States Patent
Takahashi et al.

(10) Patent No.: US 9,366,414 B2
(45) Date of Patent: Jun. 14, 2016

(54) ILLUMINATION DEVICE FOR EXCITING A FLUORESCENT SUBSTANCE

(71) Applicant: Sharp Kabushiki Kaisha, Osaka-shi (JP)

(72) Inventors: Koji Takahashi, Osaka (JP); Hidenori Kawanishi, Osaka (JP)

(73) Assignee: SHARP KABUSHIKI KAISHA, Osaka-Shi (JP)

( * ) Notice: Subject to any disclaimer, the term of this patent is extended or adjusted under 35 U.S.C. 154(b) by 21 days.

(21) Appl. No.: 14/087,711

(22) Filed: Nov. 22, 2013

(65) Prior Publication Data

US 2014/0078717 A1 Mar. 20, 2014

Related U.S. Application Data

(63) Continuation of application No. 12/939,793, filed on Nov. 4, 2010, now abandoned.

(30) Foreign Application Priority Data

Dec. 28, 2009 (JP) ..... 2009-297279
Aug. 31, 2010 (JP) ..... 2010-193296

(51) Int. Cl.

| | |
|---|---|
| ***F21V 9/00*** | (2015.01) |
| ***F21V 9/16*** | (2006.01) |
| ***F21K 99/00*** | (2016.01) |
| ***F21S 8/10*** | (2006.01) |

(Continued)

(52) U.S. Cl.
CPC ... *F21V 9/16* (2013.01); *F21K 9/56* (2013.01); *F21S 48/115* (2013.01); *F21V 29/58* (2015.01); *F21Y 2101/02* (2013.01)

(58) Field of Classification Search
CPC ..... F21K 9/56; H01L 33/50; H01L 33/502
USPC ..... 362/2, 601, 510, 166, 230, 231, 293
See application file for complete search history.

(56) References Cited

U.S. PATENT DOCUMENTS

| | | | | |
|---|---|---|---|---|
| 5,535,230 | A | 7/1996 | Abe | |
| 7,530,710 | B2 * | 5/2009 | Berben et al. | 362/231 |
| 2005/0105301 | A1 * | 5/2005 | Takeda et al. | 362/510 |

(Continued)

FOREIGN PATENT DOCUMENTS

| | | |
|---|---|---|
| CN | 1120254 | 4/1996 |
| CN | 1619903 | 5/2005 |

(Continued)

OTHER PUBLICATIONS

Takahashi et al., U.S. Office Action mailed Dec. 24, 2012, directed to U.S. Appl. No. 12/939,793; 10 pages.

(Continued)

*Primary Examiner* — William Carter
(74) *Attorney, Agent, or Firm* — Morrison & Foerster LLP

(57) ABSTRACT

Provided is an illumination device capable of reducing coherence of laser light emitted from a laser irradiation device to ensure safety to the eye at low cost. In the illumination device for exciting a fluorescent substance by irradiating the fluorescent substance with the laser light from the laser irradiation device to emit visible light for use as illumination light, a light scattering material is placed on and around an optical axis of the laser light.

16 Claims, 14 Drawing Sheets

(51) Int. Cl.
*F21V 29/58* (2015.01)
*F21Y 101/02* (2006.01)

(56) References Cited

U.S. PATENT DOCUMENTS

| | | | | |
|---|---|---|---|---|
| 2005/0152421 | A1 | 7/2005 | Fujitani | |
| 2005/0270775 | A1 | 12/2005 | Harbers et al. | |
| 2006/0164840 | A1* | 7/2006 | Song et al. | 362/341 |
| 2007/0274096 | A1* | 11/2007 | Chew | G02B 6/0031 362/609 |
| 2007/0285784 | A1 | 12/2007 | Yamada et al. | |
| 2008/0079351 | A1 | 4/2008 | Tokunaga et al. | |
| 2008/0089089 | A1 | 4/2008 | Hama et al. | |
| 2008/0117500 | A1 | 5/2008 | Narendran et al. | |
| 2008/0247151 | A1* | 10/2008 | Stenton | 362/551 |
| 2009/0140630 | A1 | 6/2009 | Kijima et al. | |
| 2010/0149496 | A1 | 6/2010 | Inoue | |
| 2010/0315574 | A1 | 12/2010 | Mizuuchi et al. | |
| 2011/0102883 | A1 | 5/2011 | Narendran et al. | |
| 2011/0102884 | A1 | 5/2011 | Narendran et al. | |
| 2011/0157865 | A1 | 6/2011 | Takahashi et al. | |

FOREIGN PATENT DOCUMENTS

| | | |
|---|---|---|
| CN | 101611500 | 12/2009 |
| JP | 2003-258353 | 9/2003 |
| JP | 2003-295319 | 10/2003 |
| JP | 2005-347263 | 12/2005 |
| JP | 2006-352105 | 12/2006 |
| JP | 2007-266484 | 10/2007 |
| JP | 2008-270229 | 11/2008 |
| JP | 2009-170723 | 7/2009 |

OTHER PUBLICATIONS

Takahashi et al., U.S. Office Action mailed Jul. 24, 2013, directed to U.S. Appl. No. 12/939,793; 9 pages.

* cited by examiner

1

ILLUMINATION DEVICE FOR EXCITING A FLUORESCENT SUBSTANCE

This application is a continuation application of U.S. Ser. No. 12/939,793, filed Nov. 4, 2010, which is based on Japanese Patent Application No. 2009-297279 filed on Dec. 28, 2009 and Japanese Patent Application No. 2010-193296 filed on Aug. 31, 2010, the contents of which are hereby incorporated by reference.

BACKGROUND OF THE INVENTION

1. Field of the Invention

The present invention relates to an illumination device for exciting a fluorescent substance by irradiating the fluorescent substance with laser light from a laser irradiation device to emit visible light for use as illumination light.

2. Description of Related Art

Conventionally, there has been proposed a safety measure regarding a communication device that uses laser light to transmit and receive signals for avoiding the risk to the eye caused by light having high coherence emitted to the outside of the transmitter.

Taking as an example an infrared communication module described in Japanese Patent Application Laid-open No. 2003-258353, in a light source device used for a transmission device of the infrared communication module, liquid or swollen gel including a dynamic light scattering system (region including light scattering system) is placed in an optical path of light emitted from a semiconductor laser element, to thereby convert the light having high coherence to incoherent light, which is not harmful to the human, by dynamic multiple light scattering (Brownian motion) at the time when the light emitted from the semiconductor laser element passes through the region including the dynamic light scattering system.

As another example, Japanese Patent Application Laid-open No. 2006-352105 describes an optical transmission device, in which a light scattering member including light scattering particles for scattering laser light is placed in an optical path of light emitted from a semiconductor laser element, so that the light emitted from the semiconductor laser element is scattered while passing through the light scattering member to thereby convert the light having high coherence to incoherent light, which is not harmful to the human.

Further, there has also been proposed an illumination device for exciting a fluorescent substance by irradiating the fluorescent substance with laser light from a laser irradiation device to emit visible light, and for converting by a reflecting mirror the visible light into parallel rays for use as illumination light (see Japanese Patent Application Laid-open No. 2003-295319). Also in such illumination device, light having high coherence may leak to the outside to lead to the alleged risk of harming the eye. Japanese Patent Application Laid-open No. 2003-295319 describes, as a countermeasure against the case where the fluorescent substance cannot entirely absorb the laser light and transmits a portion of the laser light, a configuration in which a subreflecting mirror is placed in front of the fluorescent substance so that the laser light transmitted through the fluorescent substance is reflected by the subreflecting mirror to reenter the fluorescent substance and hence be entirely absorbed by the fluorescent substance.

In the illumination device for exciting the fluorescent substance by irradiating the fluorescent substance by the laser light from the laser irradiation device to emit the visible light for use as the illumination light, in the event that the laser light having high coherence for use as the excitation light for the fluorescent substance leaks, the risk to the human eye is assumed to be high. The possible reasons are: (1) optical elements of the laser irradiation device become out of alignment due to change/deformation of parts over time, external pressure or impact, or the like; (2) the fluorescent substance is displaced due to change/deformation of parts over time, external pressure or impact, or the like; and (3) the laser light is not entirely absorbed by the fluorescent substance and a portion of the laser light is transmitted through the fluorescent substance.

Japanese Patent Application Laid-open Nos. 2003-258353 and 2006-352105 each relate to a communication device. Therefore, it is suffice to place the region including the dynamic light scattering system or the light scattering member in contact with, or to be integrated with, the semiconductor laser element as the light source. However, in the illumination device, the fluorescent substance is irradiated with the laser light emitted from the semiconductor laser element to excite the fluorescent substance, and hence the positional relationship with the fluorescent substance should be considered. In this regard, Japanese Patent Application Laid-open Nos. 2003-258353 and 2006-352105 do not provide such knowledge.

Further, although Japanese Patent Application Laid-open No. 2003-295319 describes, in order to address the above-mentioned reason (3), the configuration using the subreflecting mirror in which the laser light transmitted through the fluorescent substance is reflected by the subreflecting mirror to reenter the fluorescent substance, the cases of the above-mentioned reasons (1) and (2) are not considered.

SUMMARY OF THE INVENTION

The present invention has been made in view of the above-mentioned problems, and therefore has an object of providing at low cost an illumination device capable of ensuring safety of the eye by reducing coherence of laser light emitted from a laser irradiation device.

In order to attain the above-mentioned object, according to the present invention, there is provided an illumination device for exciting a fluorescent substance by irradiating the fluorescent substance with laser light from a laser irradiation device to emit visible light for use as illumination light, including a light scattering material on and around an optical axis of the laser light.

With this arrangement of the light scattering material, the light scattering material transmits the laser light to scatter the light in random directions and reduce coherence of the laser light, to thereby prevent light having high coherence from leaking to the outside. Further, the light scattering material is placed on and around the optical axis of the laser light so that the laser light is transmitted through the light scattering material without fail even when the optical axis of the laser light or the fluorescent substance is displaced, to thereby increase safety.

Further, according to the present invention, in the illumination device configured as above, the laser light is transmitted through the light scattering material after exciting the fluorescent substance. With this configuration, the laser light excites the fluorescent substance to be reduced in coherence, and then is transmitted through the light scattering material to be scattered in random directions and further reduced in coherence, to thereby prevent light having high coherence from leaking to the outside.

Further, according to the present invention, in the illumination device configured as above, the laser light excites the fluorescent substance after being transmitted through the light scattering material. With this configuration, the laser light is transmitted through the light scattering material to be scattered in random directions to be reduced in coherence, and then excites the fluorescent substance to be further reduced in coherence, to thereby prevent light having high coherence from leaking to the outside.

Further, according to the present invention, in the illumination device configured as above, the light scattering material and the fluorescent substance are placed to be separated from each other. With this configuration, the laser light passes through the light scattering material and is emitted to a space before exciting the fluorescent substance.

Further, according to the present invention, in the illumination device configured as above, the light scattering material and the fluorescent substance are placed in close contact with each other. With this configuration, the laser light passes through the light scattering material and excites the fluorescent substance without being emitted to the space.

Further, according to the present invention, in the illumination device configured as above, a surface of the light scattering material has projections and recesses that are smaller in size than a wavelength of the laser light. With this configuration, the laser light reflected on the surface of the light scattering material may be suppressed.

Further, according to the present invention, in the illumination device configured as above, the fluorescent substance is placed on a metal plate. With this configuration, heat generated from the fluorescent substance may be dissipated positively by using the metal plate.

Further, according to the present invention, in the illumination device configured as above, the laser irradiation device includes a plurality of semiconductor laser elements for emitting the laser light, and a condenser member for collecting the laser light emitted from each of the plurality of semiconductor laser elements onto the fluorescent substance. With this configuration, the laser light may be increased in luminance to increase the illuminance of the illumination device.

Further, according to the present invention, in the illumination device configured as above, the laser irradiation device includes a light source for emitting the laser light, and a light guiding member for guiding the laser light emitted from the light source to the fluorescent substance, and the light scattering material is placed in close contact with an output end of the light guiding member.

With this configuration, the light guiding member and the light scattering material are integrated. Therefore, even when the fluorescent substance is displaced, the laser light emitted from the light guiding member is transmitted through the light scattering material without fail. As a result, the laser light emitted from the light source may be reliably prevented from leaking to the outside while maintaining high coherence.

Further, according to the present invention, in the illumination device configured as above, the fluorescent substance is placed in close contact with an outside of the light scattering material.

With this configuration, the light guiding member, the light scattering material, and the fluorescent substance are integrated. Therefore, even when the fluorescent substance is displaced, the optical axis of the laser light follows the displacement of the fluorescent substance, and hence the light guiding member and the light scattering material are also displaced. As a result, the laser light emitted from the light guiding member is transmitted through the light scattering material without fail and excites the fluorescent substance. Consequently, the laser light emitted from the light source may be prevented more reliably from leaking to the outside while maintaining high coherence.

Further, according to the present invention, in the illumination device configured as above, the light scattering material is glass or a resin in which light scattering particles are dispersed. With this configuration, due to the difference in refraction index between the glass or resin which is a dispersion medium and the light scattering particles which are dispersoids, the laser light emitted from the laser irradiation device is refracted and scattered and exits to the outside with random phases to be reduced in coherence.

Further, according to the present invention, in the illumination device configured as above, the light scattering material includes a fluid in which light scattering particles are dispersed and a transparent container for containing the fluid. With this configuration, the light scattering particles in the fluid may be swung with time utilizing the Brownian motion, which is effective in reducing coherence of the laser light with dynamic fluctuations.

Further, according to the present invention, in the illumination device configured as above, the transparent container is brought into close contact with the fluorescent substance. With this configuration, heat generated from the excited fluorescent substance as thermal energy is transferred through the transparent container to the fluid, to thereby facilitate the Brownian motion of the light scattering particles in the fluid.

Further, according to the present invention, the illumination device configured as above further includes a circulation path of the fluid, and a pump provided midway of the circulation path. With this configuration, the fluid circulating through the circulation path fluctuates in local refraction index with time due to the flow to disturb the phase of the laser light passing through the light scattering material, which is effective in reducing coherence of the laser light. Further, with the transparent container being in close contact with the fluorescent substance, the heat generated from the fluorescent substance may be transported through the circulating fluid, and the effect of cooling the fluorescent substance is obtained at the same time.

According to the present invention, the light scattering material transmits the laser light to scatter the light in random directions and reduce coherence of the laser light, to thereby prevent light having high coherence from leaking to the outside. Further, the light scattering material is placed on and around the optical axis of the laser light. Therefore, even when the optical axis of the laser light or the fluorescent substance is displaced, the laser light is transmitted through the light scattering material without fail. As a result, the illumination device capable of ensuring safety to the eye may be provided at low cost.

DETAILED DESCRIPTION OF PREFERRED EMBODIMENTS

Hereinafter, embodiments of the present invention are described with reference to the drawings.

First Embodiment

Figure 1:
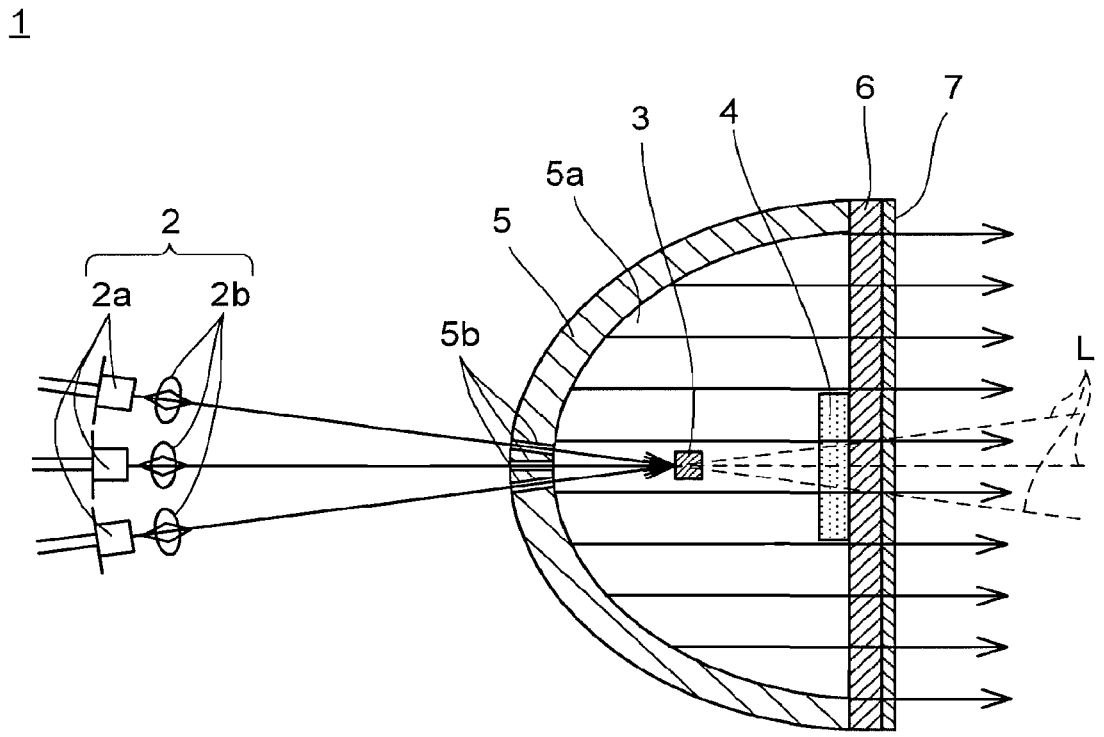
FIG. 1 is a side cross-sectional view schematically illustrating structure of an illumination device according to a first embodiment of the present invention.

Referring to FIG. 1, a first embodiment of the present invention is described. FIG. 1 is a side cross-sectional view schematically illustrating structure of an illumination device according to the first embodiment.

As illustrated in FIG. 1, the illumination device according to the present invention which is denoted by 1 includes a laser irradiation device 2, a fluorescent substance 3 irradiated with laser light from the laser irradiation device 2, and a light scattering material 4 placed on and around an optical axis L of the laser light. The illumination device 1 excites the fluorescent substance 3 by the laser light to convert the laser light to visible light (for example, white light) for use as illumination light. The illumination device 1 is used, for example, as an automobile headlight.

A reflecting mirror 5 has a concave part 5*a* for reflecting the visible light converted by the fluorescent substance 3 forward (to the right of the page in FIG. 1) and is, for example, a parabolic mirror made of a metal. A plurality of (in this embodiment, three) through holes 5*b* are formed in a region around a vertex of the reflecting mirror 5 to allow the fluorescent substance 3 in the concave part 5*a* to be irradiated with the laser light from the outside of the reflecting mirror 5 through the through holes 5*b*. The reflecting mirror 5 may alternatively be obtained by coating a main body made of a resin with a thin film of a metal having high reflectivity (for example, silver or aluminum). The coating does not need to cover the entire surface of the main body, but needs to cover at least the surface (reflecting surface) constituting the concave part 5*a*.

The laser irradiation device 2 includes a plurality of (in this embodiment, three) semiconductor laser elements 2*a* for emitting the laser light, and a plurality of collimator lenses 2*b* provided in correspondence with the semiconductor laser elements 2*a*, for converting the laser light emitted from the semiconductor laser elements 2*a* into parallel rays. When the semiconductor laser elements 2*a* directly emit satisfactory parallel rays, the collimator lenses 2*b* are not necessarily provided.

In the subject application, the "optical axis" of the laser light does not mean the trajectory of the actually emitted laser light, but means the line extended from the trajectory of the laser light emitted from the laser irradiation device 2. Further, the "collimator" is an optical element that is used for producing and adjusting an optical instrument and generates the parallel rays. Further, the "fluorescent substance" means the product obtained by processing particles of a fluorescent material in some way into a bulk form or dispersing the particles of the fluorescent material in a bulk, for example, mixing the particles of the fluorescent material into glass resin or the like and solidifying the mixture, mixing the particles of the fluorescent material into a binder and applying the mixture, or solidifying the particles of the fluorescent material by sintering or pressing.

In this embodiment, for example, three semiconductor laser elements 2*a* (total output: 3 W) each having an output of 1 W and emitting laser light that has a wavelength of 405 nm (blue-violet) are used, and the laser light is converted into the parallel rays through the collimator lenses 2*b* so that three parallel rays are crossed on the rear surface of the fluorescent substance 3. This way, the fluorescent substance 3 may be excited by irradiating the fluorescent substance 3 in a concentrated manner with the laser light having high luminance.

The fluorescent material may be, for example, a composite material of $Ce^{3+}$-activated $\alpha$-SiAlON and $CaAlSiN_3:Eu^{2+}$. The outer shape of the fluorescent substance 3 is ideally a shape that is symmetric about the center axis, and a cylinder, a spindle, a square rod, or the like may be adopted. When the fluorescent substance 3 is excited with the blue-violet laser light having the wavelength of 405 nm, the former material emits blue-green light and the latter material emits red light to be mixed together, with the result that white fluorescent light is emitted. The fluorescent substance 3 is fixed to a focal point in the concave part 5*a* of the reflecting mirror 5 by a fixture (not shown) so that the fluorescent light from the fluorescent substance 3 is projected forward by the reflecting mirror 5.

A cover 6 made of a transparent resin for covering a front end surface of the reflecting mirror 5 is attached by fitting to the reflecting mirror 5. The cover 6 has a function of preventing dust or the like from entering the reflecting mirror 5. It is preferred that the shape of the cover 6 be a disk corresponding to the circumference of the front end surface of the reflecting mirror 5. However, the present invention is not limited thereto, and any shape may be adopted.

The light scattering material 4 is a characteristic component of the present invention and functions to scatter light in random directions and reduce coherence of the laser light.

The light scattering material 4 is attached with an adhesive to the back surface of the cover 6 to be positioned in front of the fluorescent substance 3. With this position of the light scattering material 4, the laser light excites the fluorescent substance 3 to be reduced in coherence, and then is transmitted through the light scattering material 4 to be scattered in random directions and further reduced in coherence. Therefore, the light having high coherence is prevented from leaking to the outside. The adhesive may be a known adhesive that is transparent after being cured. The light scattering material 4 may be alternatively attached by an adhesive to the front surface of the cover 6. The cover 6 also has a function of holding the light scattering material 4, and hence there is no need for a part for holding the light scattering material 4. Therefore, it is possible to avoid the demerit that the part for holding the light scattering material 4 casts an unnecessary shadow on the concave part 5*a* of the reflecting mirror 5 to hinder the illumination.

Further, the light scattering material 4 is positioned so as to have its effective portion on and around the optical axis L of the laser light. With this position of the light scattering material 4, even when the optical axis L of the laser light or the fluorescent substance 3 is displaced, it is possible to avoid the laser light from leaking to the outside while maintaining high coherence. Therefore, it is possible to provide at low cost the illumination device 1 capable of ensuring safety of the eye.

It is preferred that the outer shape of the light scattering material 4 be symmetric about the center axis so as to cover displacement of the optical axis L of the laser light or the fluorescent substance 3 in any direction on a plane perpendicular to the center axis, and for example, a disk, a square plate, or the like may be adopted. The area of the cross section of the light scattering material 4 perpendicular to the center axis should be equal to or larger than the cross section of the fluorescent substance 3 perpendicular to the center axis so as to cover displacement of the fluorescent substance 3 out of the optical axis L of the laser light, and is preferably such a size that the fluorescent substance 3 is hidden inside the light scattering material 4 when the illumination device 1 is viewed from the front.

In this embodiment, glass in which light scattering particles are dispersed uniformly in high concentration is used as the light scattering material 4. Silicon oxide particles (diameter: 1 μm) may be suitably used as the light scattering particles. Such light scattering particles are dispersed in a molten glass base material and hardened into a desired shape in a mold, to thereby produce the light scattering material 4. The ratio by weight of the light scattering particles and the glass base material is, for example, 30%. With this light scattering material 4, the laser light emitted from the laser irradiation device 2 is refracted and scattered due to the difference in refraction index between glass and silicon oxide, with the result that the laser light exits to the outside with random phases and hence is reduced in coherence.

As illustrated in FIG. 1, a filter 7 for absorbing the laser light having the wavelength of 405 nm and transmitting the white light may be provided on the outer surface of the cover 6. The filter 7 ensures the reduction in coherence of the laser light by the light scattering material 4. 99% of the laser light is absorbed by the filter 7 without the light scattering material 4, but 1% of the laser light inevitably leaks to the outside. For example, the laser output of 3 W leads to a leakage of 30 mW, which is dangerous when the laser light leaks while maintaining high coherence. In this embodiment, the light scattering material 4 is positioned behind the filter 7. Therefore, the laser light is transmitted through the light scattering material 4 to be scattered and sufficiently reduced in coherence, and then passes through the filter 7. This so-called double safety measure may prevent 100% of the leakage of the laser light.

Second Embodiment

Figure 2:
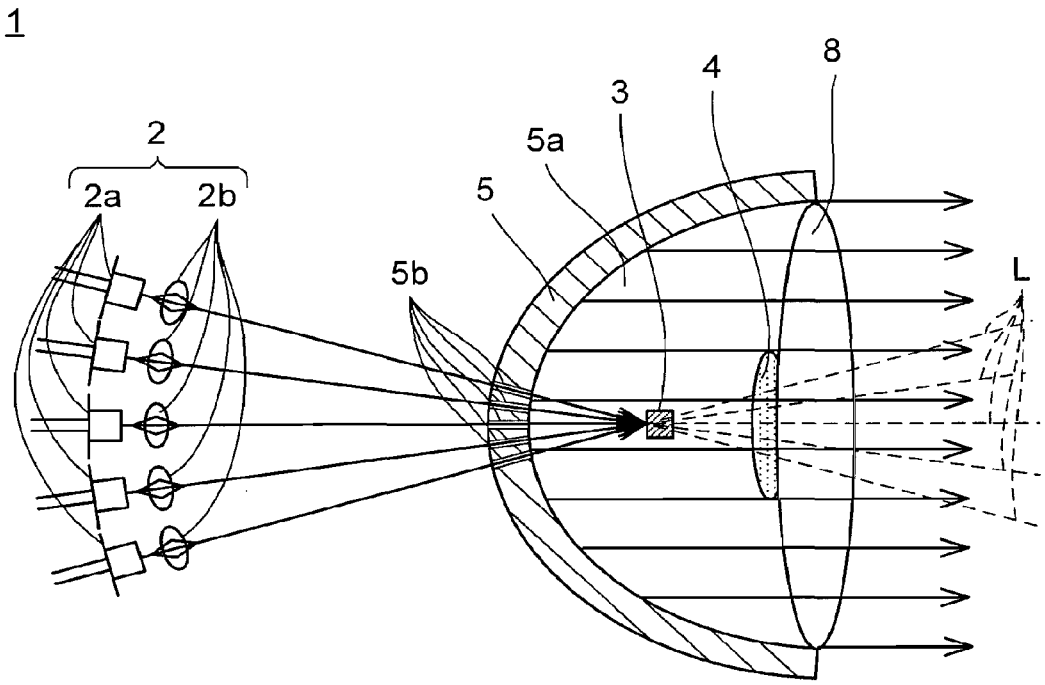
FIG. 2 is a side cross-sectional view schematically illustrating structure of an illumination device according to a second embodiment of the present invention.

Next, referring to FIG. 2, a second embodiment of the present invention is described. FIG. 2 is a side cross-sectional view schematically illustrating structure of an illumination device according to the second embodiment. In the illumination device according to this embodiment, components similar to those of the illumination device according to the first embodiment illustrated in FIG. 1 are denoted by the same reference symbols, and their detailed descriptions are omitted.

The illumination device according to this embodiment which is denoted by 1 includes, instead of the cover 6 of the illumination device 1 of the first embodiment, a lens 8 inside the circumference at the front end of the reflecting mirror 5. The lens 8 has not only the function of controlling the solid angle of the fluorescent light to be projected but also the function of the cover for preventing dust or the like from entering the reflecting mirror 5. A convex lens is illustrated in FIG. 2 as an example of the lens 8. However, it should be noted that a concave lens or other such lenses may be used depending on the use and purpose of the illumination device.

Similarly to the first embodiment, the laser irradiation device 2 includes a plurality of (in this embodiment, five) semiconductor laser elements 2*a* for emitting laser light, and a plurality of collimator lenses 2*b* provided in correspondence with the semiconductor laser elements 2*a*, for converting the laser light emitted from the semiconductor laser elements 2*a* into parallel rays. When the semiconductor laser elements 2*a* directly emit satisfactory parallel rays, the collimator lenses 2*b* are not necessarily provided.

In this embodiment, for example, five semiconductor laser elements 2*a* (total output: 2.5 W) each having an output of 0.5 W and emitting laser light having a wavelength of 450 nm (blue) are used, and the laser light is converted into the parallel rays through the collimator lenses 2*b* so that five parallel rays are crossed on the rear surface of the fluorescent substance 3. This way, the fluorescent substance 3 may be excited by irradiating the fluorescent substance 3 in a concentrated manner with the laser light having high luminance.

A plurality of (in this embodiment, five) through holes 5*b* are formed in the region around the vertex of the reflecting mirror 5 to allow the fluorescent substance 3 in the concave part 5*a* to be irradiated with the laser light from the outside of the reflecting mirror 5 through the through holes 5*b*.

The material for the fluorescent substance 3 may be, for example, $(Y,Gd)_3Al_5O_{12}$:Ce. The outer shape of the fluorescent substance 3 is ideally a shape that is symmetric about the center axis, and a cylinder, a spindle, a square rod, or the like may be adopted. When the fluorescent substance 3 is excited with the blue laser light having the wavelength of 450 nm, the material emits yellow light to be mixed with excess blue, with the result that white fluorescent light is emitted. The fluorescent substance 3 is fixed to the focal point in the concave part 5*a* of the reflecting mirror 5 by a fixture (not shown) so that the fluorescent light from the fluorescent substance 3 is projected forward by the reflecting mirror 5.

The light scattering material 4 is attached with an adhesive to the back surface of the lens 8 to be positioned on and around the optical axis L of the laser light in front of the fluorescent substance 3. The adhesive may be a known adhesive that is transparent after being cured. The light scattering material 4 may be alternatively attached by an adhesive to the front surface of the lens 8. The lens 8 also has a function of holding the light scattering material 4, and hence there is no need for a part for holding the light scattering material 4. Therefore, it is possible to avoid the demerit that the part for holding the light scattering material 4 casts an unnecessary shadow on the concave part 5*a* of the reflecting mirror 5 to hinder the illumination.

In this embodiment, a resin in which light scattering particles are dispersed uniformly in high concentration is used as the light scattering material 4. Specifically, silicone resin in which titanium oxide particles (diameter: 2 μm) are dispersed may be suitably used. Such light scattering particles are dispersed in a molten glass base material and hardened into a desired shape in a mold, to thereby produce the light scattering material 4. The ratio by weight of the light scattering particles and the glass base material is, for example, 30%. With this light scattering material, the laser light emitted from the laser irradiation device 2 is refracted and scattered due to the difference in refraction index between glass and the titanium oxide particles, with the result that the laser light exits to the outside with random phases and hence is reduced in coherence.

According to the light scattering material 4 of this embodiment, the laser light emitted from the laser irradiation device 2 is refracted and scattered due to the difference in refraction index between the silicone resin and the titanium oxide particles, with the result that the laser light exits to the outside with random phases and hence is reduced in coherence.

Similarly to the first embodiment, a filter having a function of absorbing the laser light may be provided on the front surface of the lens 8.

Third Embodiment

Figure 3:
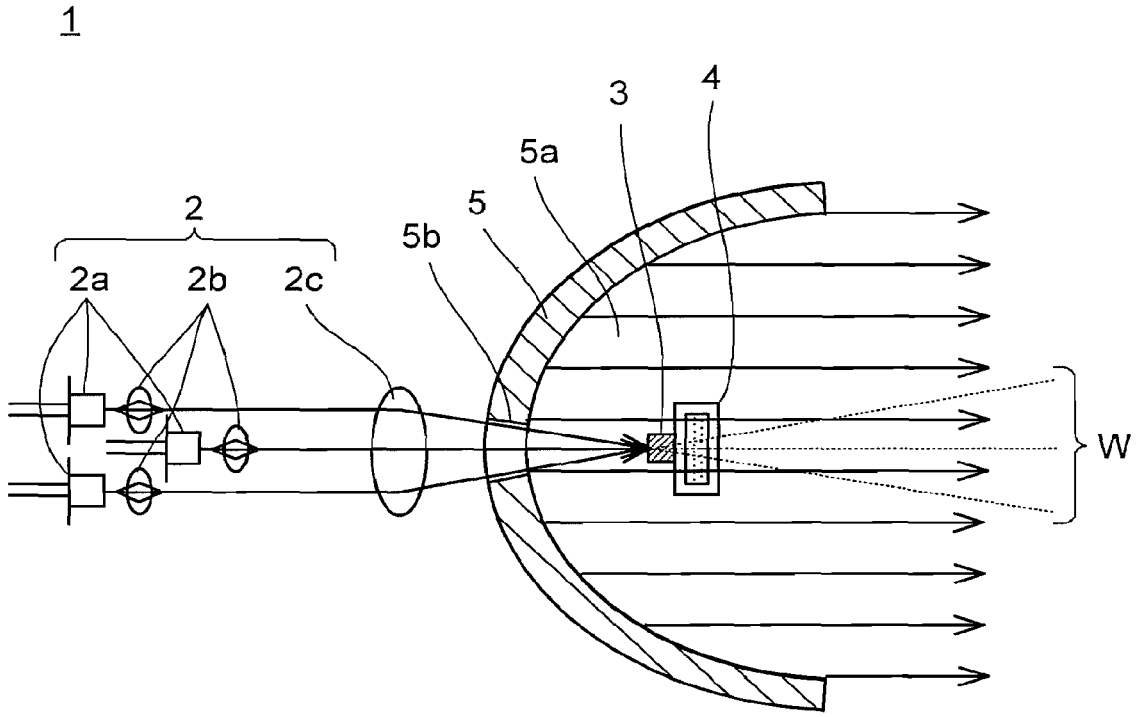
FIG. 3 is a side cross-sectional view schematically illustrating structure of an illumination device according to a third embodiment of the present invention.
Figure 4:
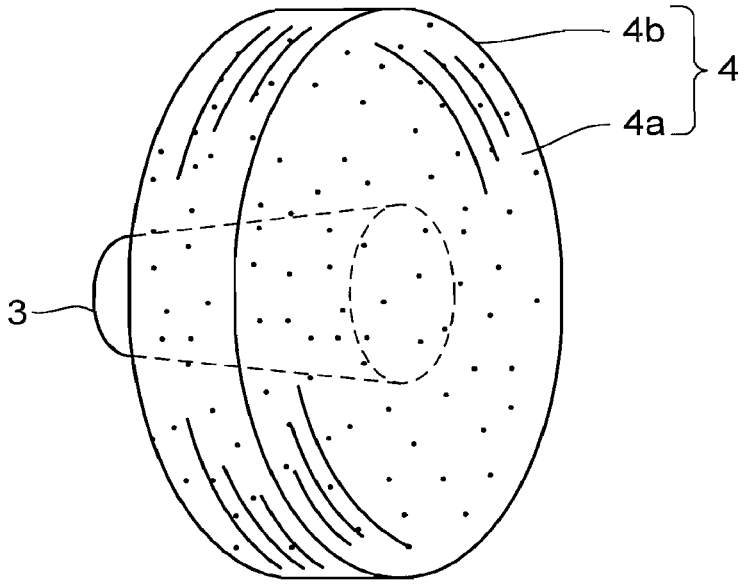
FIG. 4 is a perspective view illustrating a light scattering material used in the illumination device according to the third embodiment.

Next, referring to FIGS. 3 and 4, a third embodiment of the present invention is described. FIG. 3 is a side cross-sectional view schematically illustrating structure of an illumination device according to the third embodiment, and FIG. 4 is a perspective view illustrating a light scattering material used in the illumination device. In the illumination device according to this embodiment, components similar to those of the illumination device according to the first embodiment illustrated in FIG. 1 are denoted by the same reference symbols, and their detailed descriptions are omitted.

In this embodiment, the laser irradiation device 2 includes a plurality of (in this embodiment, three) semiconductor laser elements 2*a* for emitting laser light, a plurality of collimator lenses 2*b* provided in correspondence with the semiconductor laser elements 2*a*, for converting the laser light emitted from the semiconductor laser elements 2*a* into parallel rays, and a condenser lens 2*c* provided in correspondence with the semiconductor laser elements 2*a* and the collimator lenses 2*b*, for collecting the laser light converted into the parallel rays. When the semiconductor laser elements 2*a* directly emit satisfactory parallel rays, the collimator lenses 2*b* are not necessarily provided.

In the laser irradiation device 2 of this embodiment, the condenser lens 2*c* collects the laser light, and hence the laser light after being transmitted through the condenser lens 2*c* is no longer parallel rays and is rays that converge at the fluorescent substance. Unlike the above-mentioned embodiments, the laser light that irradiates the fluorescent substance is not parallel rays. Therefore, if the laser light passes through the fluorescent substance, then the laser light is to diverge. In the subject application, even when the laser light is not parallel rays as in this case, the range in which the coherent light diverges is broadly expressed by the language "optical axis".

A through hole 5*b* is formed in a region including and around the vertex of the reflecting mirror 5 to allow the fluorescent substance 3 in the concave part 5*a* to be irradiated with the laser light from the outside of the reflecting mirror 5 through the through hole 5*b*.

In this embodiment, the light scattering material 4 includes, as illustrated in FIGS. 3 and 4, a fluid 4*a* in which light scattering particles are dispersed, and a transparent container 4*b* for containing the fluid 4*a*. As the fluid 4*a* in which the light scattering particles are dispersed, for example, silicone oil containing silicon oxide particles in high concentration may be suitably used. As the transparent container 4*b*, a transparent glass container having a disk shape may be suitably used.

The light scattering material 4 is positioned in and around the range denoted by W in which the coherent light diverges, and in front of the fluorescent substance 3 so that the transparent container 4*b* is in close contact with the front surface of the fluorescent substance 3. For the close contact between the transparent container 4*b* and the fluorescent substance 3, it is preferred to use an adhesive so as not to cast an unnecessary shadow in the concave part 5*a* of the reflecting mirror 5. The adhesive may be a known adhesive that is transparent after being cured.

According to the light scattering material 4 of this embodiment, the light scattering particles in the fluid 4*a* may be swung with time utilizing the Brownian motion, which is effective in reducing coherence of the laser light passing through the light scattering material 4 with dynamic fluctuations. With the transparent container 4*b* being in close contact with the fluorescent substance 3, the heat emitted from the excited fluorescent substance 3 as thermal energy is transferred through the transparent container 4*b* to the fluid 4*a*, to thereby facilitate the Brownian motion of the light scattering particles in the fluid 4*a*.

Similarly to the first embodiment, a cover may be provided on the front end surface of the reflecting mirror 5, and a filter for absorbing the laser light may be further provided on the cover.

Fourth Embodiment

Figure 5:
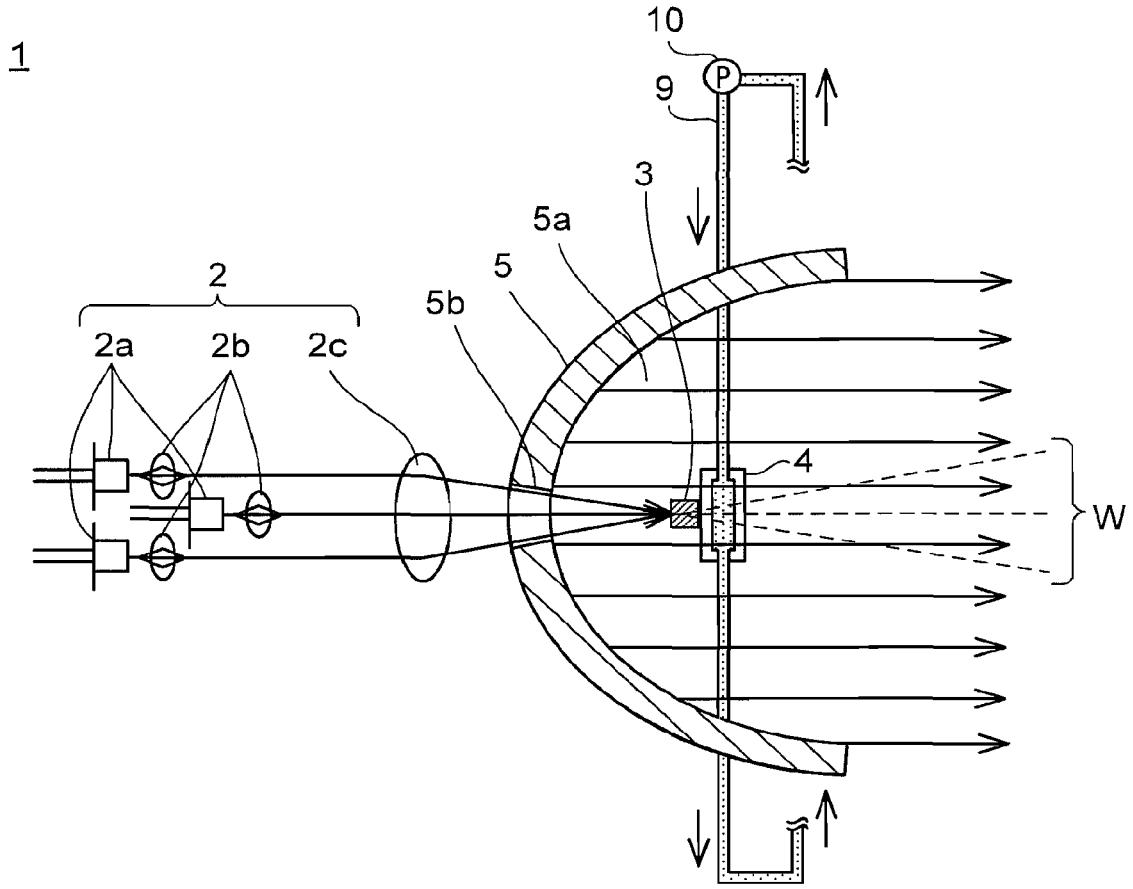
FIG. 5 is a side cross-sectional view schematically illustrating structure of an illumination device according to a fourth embodiment of the present invention.
Figure 6:
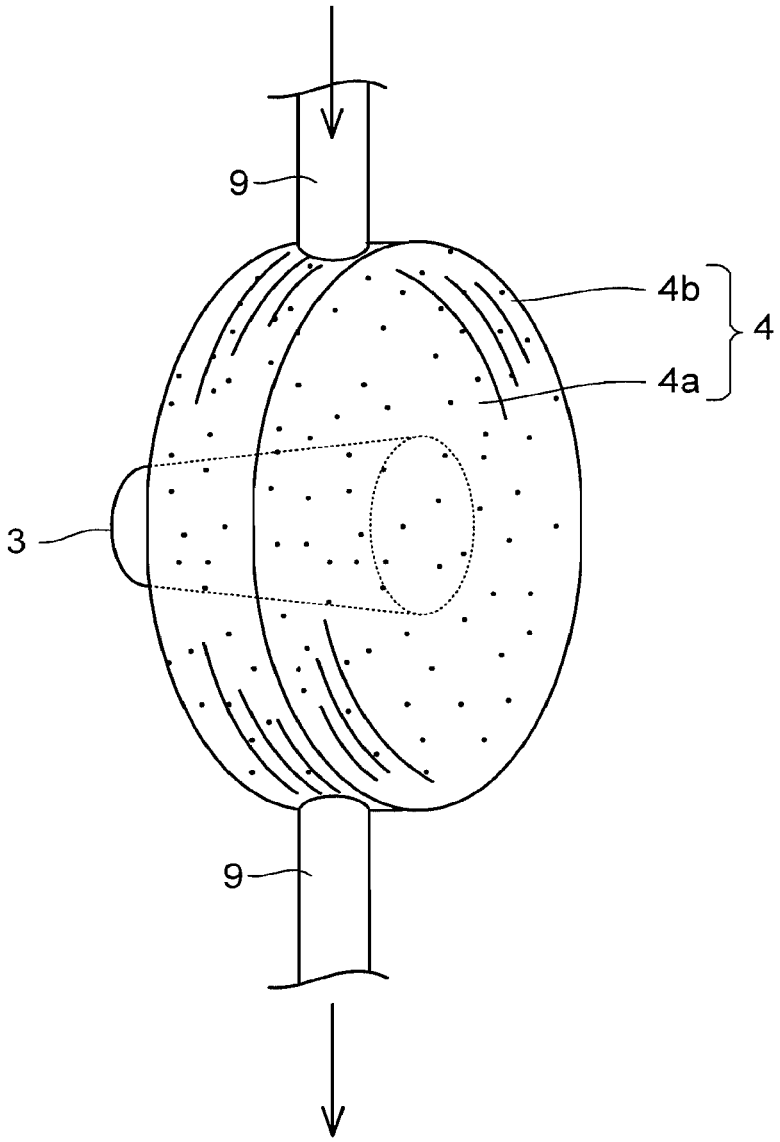
FIG. 6 is a perspective view illustrating a light scattering material used in the illumination device according to the fourth embodiment.

Next, referring to FIGS. 5 and 6, a fourth embodiment of the present invention is described. FIG. 5 is a side cross-sectional view schematically illustrating structure of an illumination device according to the fourth embodiment, and FIG. 6 is a perspective view illustrating a light scattering material used in the illumination device. In the illumination device according to this embodiment, components similar to those of the illumination device according to the third embodiment illustrated in FIGS. 3 and 4 are denoted by the same reference symbols, and their detailed descriptions are omitted.

Similarly to the third embodiment, the laser irradiation device 2 includes a plurality of (in this embodiment, three) semiconductor laser elements 2*a* for emitting laser light, a plurality of collimator lenses 2*b* provided in correspondence with the semiconductor laser elements 2*a*, for converting the laser light emitted from the semiconductor laser elements 2*a* into parallel rays, and a condenser lens 2*c* provided in correspondence with the semiconductor laser elements 2*a* and the collimator lenses 2*b*, for collecting the laser light converted into the parallel rays. When the semiconductor laser elements 2*a* directly emit satisfactory parallel rays, the collimator lenses 2*b* are not necessarily provided.

In the laser irradiation device 2 of this embodiment, the condenser lens 2*c* collects the laser light, and hence the laser light after being transmitted through the condenser lens 2*c* is no longer parallel rays and is rays that converge at the fluorescent substance. Unlike the above-mentioned embodiments, the laser light that irradiates the fluorescent substance is not parallel rays. Therefore, if the laser light passes through the fluorescent substance, then the laser light is to diverge. In the subject application, even when the laser light is not parallel rays as in this case, the range in which the coherent light diverges is broadly expressed by the language "optical axis".

Similarly to the third embodiment, the light scattering material 4 includes, as illustrated in FIGS. 5 and 6, a fluid 4*a* in which light scattering particles are dispersed, and a transparent container 4*b* for containing the fluid 4*a*. As the fluid 4*a* in which the light scattering particles are dispersed, for example, silicone oil containing silicon oxide particles in high concentration may be suitably used. As the transparent container 4*b*, a transparent glass container having a disk shape may be suitably used.

The light scattering material 4 is positioned in and around the range denoted by W in which the coherent light diverges, and in front of the fluorescent substance 3 so that the transparent container 4*b* is in close contact with the front surface of the fluorescent substance 3. For the close contact between the transparent container 4*b* and the fluorescent substance 3, it is preferred to use an adhesive so as not to cast an unnecessary shadow in the concave part 5*a* of the reflecting mirror 5. The adhesive may be a known adhesive that is transparent after being cured.

In this embodiment, as illustrated in FIG. 5, a pipe 9 constituting a closed circuit is connected to an upper end and a lower end of the transparent container 4*b*, to thereby form a circulation path of the fluid 4*a*. Further, a pump 10 as a power source is provided midway of the circulation path so that the pump 10 drives the fluid 4*a* to be circulated in the circulation path.

According to the light scattering material 4 of this embodiment, the light scattering particles in the fluid 4*a* fluctuate in local refraction index with time due to the flow of the fluid 4*a* circulating through the circulation path 9 to disturb the phase of the laser light passing through the light scattering material 4, which is effective in reducing coherence of the laser light. Further, with the transparent container 4*b* being in close contact with the fluorescent substance 3, the heat generated from the fluorescent substance 3 may be transported through the circulating silicone oil, and the effect of cooling the fluorescent substance 3 is obtained at the same time. Therefore, the change over time of the fluorescent substance 3 may be suppressed to prolong the lifetime.

Similarly to the first embodiment, a cover may be provided on the front end surface of the reflecting mirror 5, and a filter for absorbing the laser light may be further provided on the cover.

Fifth Embodiment

Figure 7:
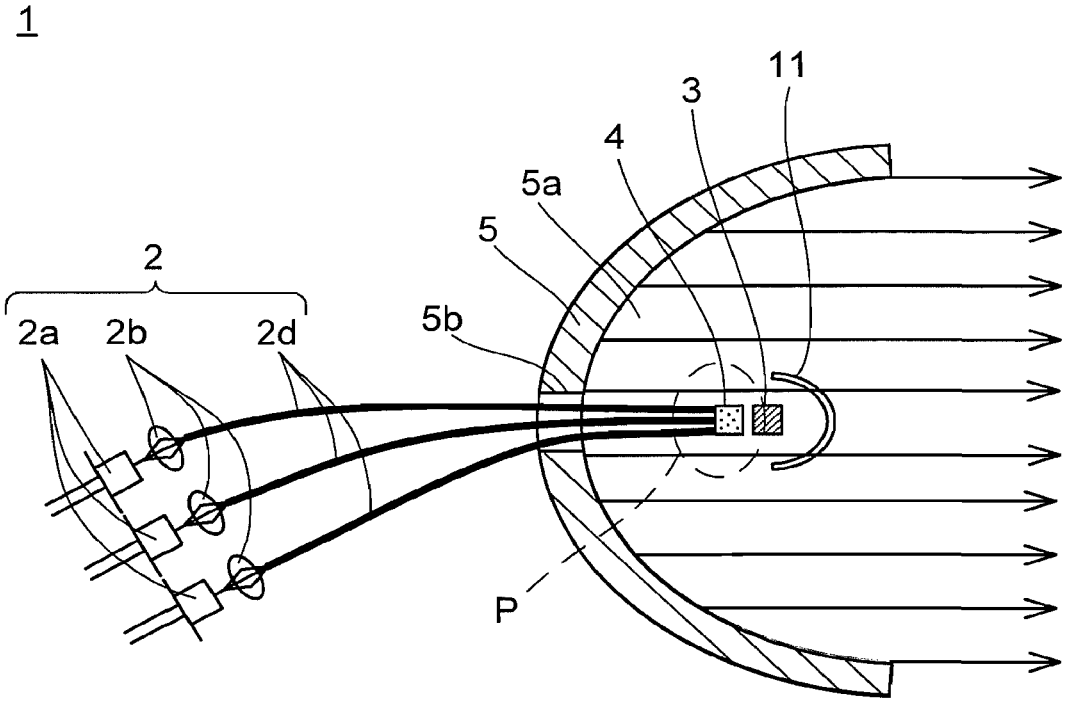
FIG. 7 is a side cross-sectional view schematically illustrating structure of an illumination device according to a fifth embodiment of the present invention.
Figure 8:
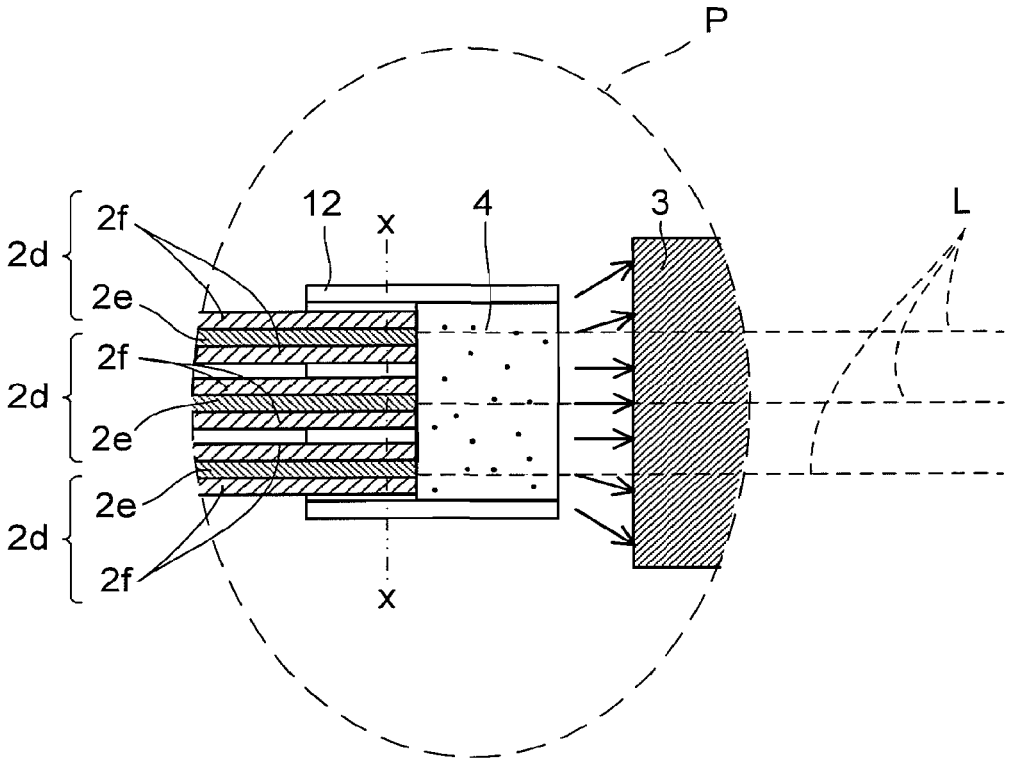
FIG. 8 is an enlarged view of a portion (portion P) encircled by the broken line of FIG. 7.
Figure 9:
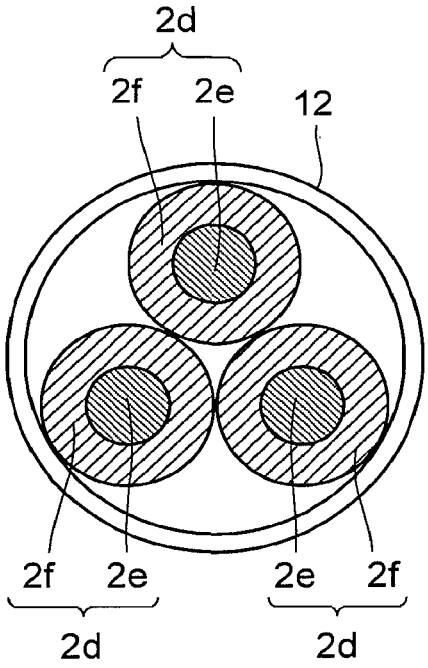
FIG. 9 is a sectional view taken along the line x-x of FIG. 8.

Next, referring to FIGS. 7 to 9, a fifth embodiment of the present invention is described. FIG. 7 is a side cross-sectional view schematically illustrating structure of an illumination device according to the fifth embodiment, FIG. 8 is an enlarged view of a portion (portion P) encircled by the broken line of FIG. 7, and FIG. 9 is a sectional view taken along the line x-x of FIG. 8. In the illumination device according to this embodiment, components similar to those of the illumination device according to the first embodiment illustrated in FIGS. 1 and 2 are denoted by the same reference symbols, and their detailed descriptions are omitted.

In the illumination device 1 according to this embodiment, the laser irradiation device 2 includes a plurality of (in the example of FIG. 7, three) semiconductor laser elements (light sources) 2*a* for emitting laser light, a plurality of collimator lenses 2*b* provided in correspondence with the semiconductor laser elements 2*a*, for converting the laser light emitted from the semiconductor laser elements 2*a* into parallel rays, and optical fibers 2*d* provided in correspondence with the semiconductor laser elements 2*a* and the collimator lenses 2*b*, for guiding and emitting the laser light converted into the parallel rays. The optical fibers 2*d* are an example of a light guiding member for guiding and emitting the laser light emitted from the semiconductor laser elements 2*a* to the fluorescent substance 3, and the light guiding member is not limited to the optical fibers.

The optical fibers 2*d* may be an optical fiber of known structure including, as illustrated in FIGS. 8 and 9, a core 2*e* at the core and cladding 2*f* covering the periphery of the core 2*e*. In this configuration of the optical fibers 2*d*, after entering from one end (input end) of the core 2*e*, the laser light travels inside the core 2*e* while being reflected at the boundary between the core 2*e* and the cladding 2*f* to be emitted from the other end (output end) of the core 2*e*.

As illustrated in FIG. 8, the light scattering material 4 is placed in close contact with the output ends of the optical fibers 2*d* so as to be positioned behind the fluorescent substance 3 (to the left of the page in FIG. 7). With this configuration of the light scattering material, the laser light is transmitted through the light scattering material 4 to be scattered in random directions and reduced in coherence, and then excites the fluorescent substance 3. Therefore, in the event that optical elements of the laser irradiation device become out of alignment due to the change or deformation over time of parts, external pressure or impact, or the like, or in the event that the fluorescent substance is displaced due to the change or deformation over time of parts, external pressure or impact, or the like, the excitation light from the semiconductor laser is low in coherence, and hence light having high coherence is prevented from leaking to the outside.

For the close contact between the optical fibers 2*d* and the light scattering material 4, it is preferred to use a ferrule 12 made of a metal. In FIG. 8, for the convenience of description, three optical fibers 2*d* are illustrated as being arranged vertically at the output ends, but in reality, as illustrated in FIG. 9, the optical fibers 2*d* are bundled together as closely as possible by the cylindrical ferrule 12 to form a bale when viewed along the sectional line x-x. By thus integrating the light scattering material 4 with the optical fibers 2*d*, the optical fibers 2*d* may be fixed to the position where the light is reliably guided from the semiconductor laser elements 2*a* to the fluorescent substance 3, and at the same time, the light scattering material 4 may be fixed to the position where the laser light emitted from the optical fibers 2*d* passes through the light scattering material 4 without fail.

The light scattering material 4 is positioned so as to have its effective portion on and around the optical axis L of the laser light. In this embodiment, the "optical axis" of the laser light is a line indicated by the line extended from the center axis at the output end of each of the optical fibers 2*d*, and does not necessarily coincide with the trajectory actually taken by the emitted laser light.

It should be noted that a concave subreflecting mirror 11 is fixed in the concave part 5*a* of the reflecting mirror 5 in front of the fluorescent substance 3 by a fixture (not shown). The subreflecting mirror 11 is a hemispherical mirror. This way, the fluorescent light emitted forward from the fluorescent substance 3 may be reflected back to the fluorescent substance 3 by the subreflecting mirror 11, and hence the fluorescent light emitted in the opposite direction to the reflecting mirror 5 may be reused. It is preferred that the subreflecting mirror 11 be small in size so as not to block the light projected from the reflecting mirror 5 as much as possible.

In this embodiment, the light scattering material 4 is placed to be separated from the fluorescent substance 3 held at the focal point in the concave part 5*a* of the reflecting mirror 5. Therefore, the laser light emitted from the optical fibers 2*d* passes through the light scattering material 4 and is emitted to a space before exciting the fluorescent substance 3.

The light scattering material 4 may suitably be, as described in the above-mentioned embodiments, any material selected from glass or a resin in which light scattering particles are dispersed, or a transparent container containing a fluid in which light scattering particles are dispersed.

The light traveling through the optical fibers 2*d* basically maintains high coherence comparable to that of the laser light emitted from the semiconductor laser elements 2*a*, but may be reduced in coherence by being transmitted through the light scattering material 4. The laser light does not change in wavelength after the reduction in coherence, and reduction in luminance may be suppressed by adjusting the number of the semiconductor laser elements 2*a* and the length of the light scattering material 4. Therefore, the fluorescent substance 3 provided outside the light scattering material 4 may be irradiated with the laser light to emit sufficient fluorescent light.

According to the illumination device of this embodiment, the flexible optical fibers 2*d* as the light guiding member are used to guide the laser light emitted from the semiconductor laser elements 2*a* as the light sources to the fluorescent substance 3. Therefore, as compared to the cases of the first to fourth embodiments in which the condenser lens is used to collect the laser light onto the fluorescent substance 3, there is a merit that the accuracy of the alignment positions of the optical elements is not required. Further, in designing the illumination device, the flexibility in arrangement of the semiconductor laser elements 2*a* is increased, to thereby broaden the application of the illumination device such as distant illumination.

It should be noted that, similarly to the first embodiment, a cover may be provided on the front end surface of the reflecting mirror 5, and a filter for absorbing the laser light may be further provided on the cover.

Sixth Embodiment

Figure 10:
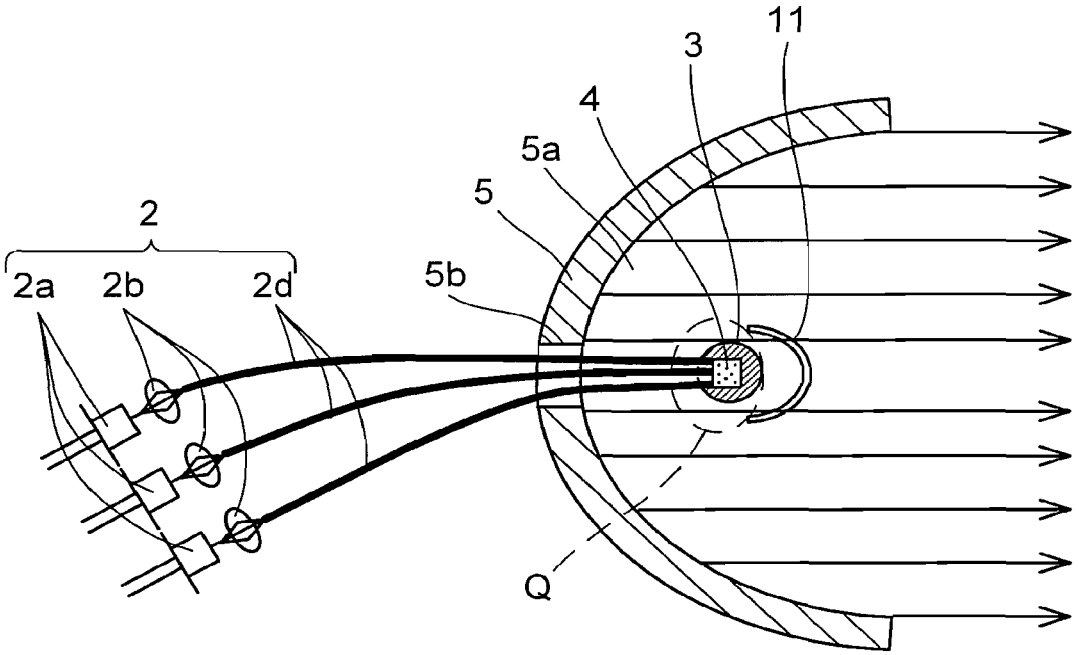
FIG. 10 is a side cross-sectional view schematically illustrating structure of an illumination device according to a sixth embodiment of the present invention.
Figure 11:
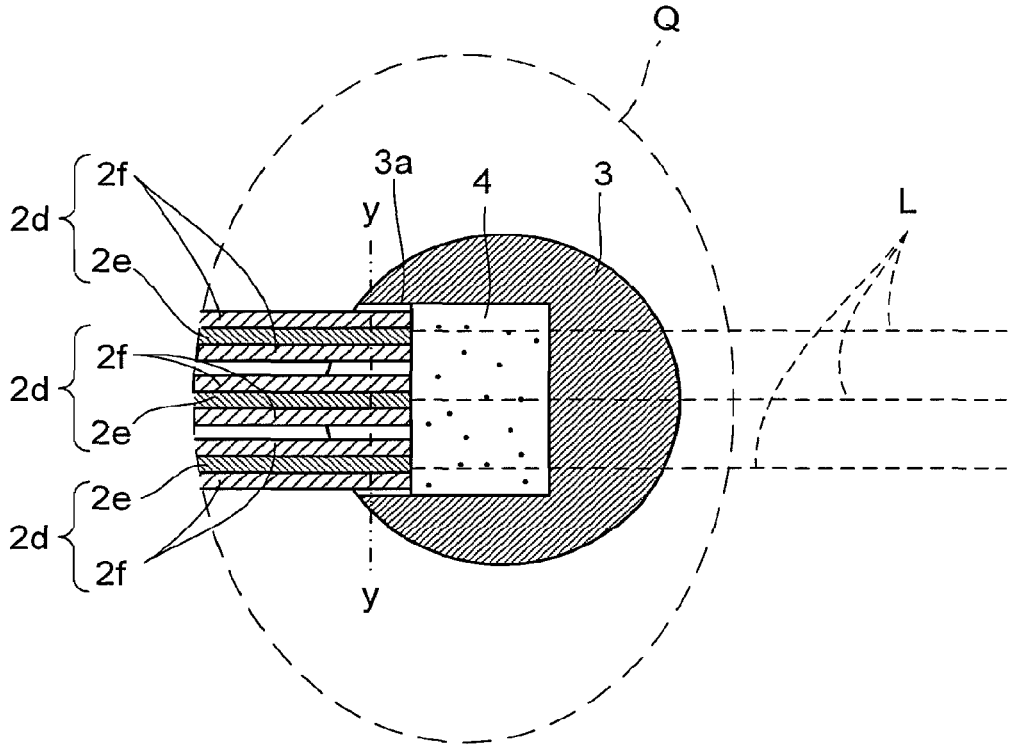
FIG. 11 is an enlarged view of a portion (portion Q) encircled by the broken line of FIG. 10.
Figure 12:
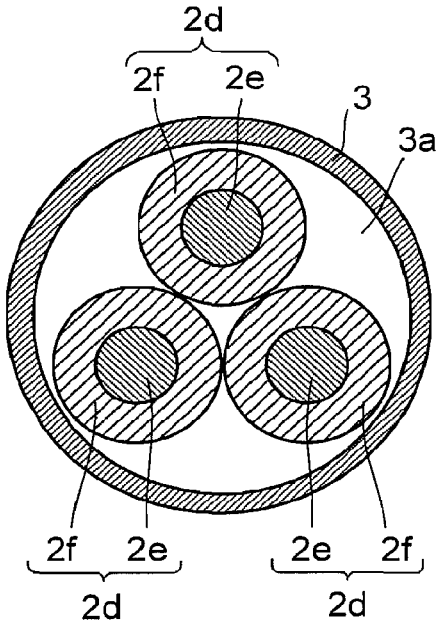
FIG. 12 is a sectional view taken along the line y-y of FIG. 11.

Next, referring to FIGS. 10 to 12, a sixth embodiment of the present invention is described. FIG. 10 is a side cross-sectional view schematically illustrating structure of an illumination device according to the sixth embodiment, FIG. 11 is an enlarged view of a portion (portion Q) encircled by the broken line of FIG. 10, and FIG. 12 is a sectional view taken along the line y-y of FIG. 11. In the illumination device according to this embodiment, components similar to those of the illumination device according to the fifth embodiment illustrated in FIGS. 7 to 9 are denoted by the same reference symbols, and their detailed descriptions are omitted.

In the laser illumination device 1 according to this embodiment, similarly to the fifth embodiment, the laser irradiation device 2 includes a plurality of (in the example of FIG. 10, three) semiconductor laser elements (light sources) 2*a* for emitting laser light, a plurality of collimator lenses 2*b* provided in correspondence with the semiconductor laser elements 2*a*, for converting the laser light emitted from the semiconductor laser elements 2*a* into parallel rays, and optical fibers 2*d* provided in correspondence with the semiconductor laser elements 2*a* and the collimator lenses 2*b*, for guiding and emitting the laser light converted into the parallel rays. The optical fibers 2*d* are an example of a light guiding member for guiding and emitting the laser light emitted from the semiconductor laser elements 2*a* to the fluorescent substance 3, and the light guiding member is not limited to the optical fibers.

The fluorescent substance 3 held at the focal point in the concave part 5*a* of the reflecting mirror 5 includes, as illustrated in FIGS. 11 and 12, a cavity portion 3*a* corresponding to the outer shape of the light scattering material 4 in the rear center. The axial length of the cavity portion 3*a* is set longer than that of the light scattering material 4.

As illustrated in FIGS. 10 and 11, the light scattering material 4 is placed in close contact with the output ends of the optical fibers 2*d*. The fixation of the optical fibers 2*d* and the light scattering material 4 is accomplished by holding the light scattering material 4 in close contact with the output ends of the optical fibers 2*d*, and then inserting the light scattering material 4 and the optical fibers 2*d* into the cavity portion 3*a* of the fluorescent substance 3. As illustrated in FIG. 11, the outer shape of the fluorescent substance 3 covering the light scattering material 4 is desirably a sphere so that the fluorescent light may be emitted around in all directions. However, the outer shape may be a shape that is symmetric about the center axis, and for example, a cylinder, a square rod, or the like may be adopted.

It should be noted that, in this embodiment, the front-to-back positional relationship of the light scattering material 4 with respect to the fluorescent substance 3 may seem unclear, but considering the function of the light scattering material 4 of reducing coherence of the laser light before exciting the fluorescent substance 3, similarly to the fifth embodiment, the light scattering material 4 may be regarded as being positioned behind the fluorescent substance 3.

In this embodiment, the light scattering material 4 is placed in close contact with the fluorescent substance 3 held at the focal point in the concave part 5*a* of the reflecting mirror 5. Therefore, the laser light emitted from the optical fibers 2*d* passes through the light scattering material 4 and excites the fluorescent substance 3 without being emitted to the space. Further, with the fluorescent substance 3 covering the wide range from the peripheral surface to the front surface of the light scattering material 4, the entire laser light may irradiate the fluorescent substance 3.

The light scattering material 4 may suitably be, as described in the above-mentioned embodiments, glass or a resin in which light scattering particles are dispersed, or a transparent container containing a fluid in which light scattering particles are dispersed.

According to the illumination device of this embodiment, the optical fibers 2*d*, the light scattering material 4, and the fluorescent substance 3 are integrated. Therefore, even when the fluorescent substance 3 is displaced, the optical axis L of the laser light follows the displacement of the fluorescent substance 3, and hence the optical fibers 2*d* and the light scattering material 4 are also displaced. As a result, the laser light emitted from the optical fibers 2*d* is transmitted through the light scattering material 4 without fail and excites the fluorescent substance 3, to thereby reliably prevent the laser light emitted from the semiconductor laser elements 2*a* from leaking to the outside while maintaining high coherence. Further, there is employed a configuration in which, in the event that the fluorescent substance 3 is deteriorated or lost due to the change or deformation over time of parts, external pressure or impact, or the like, the laser light is reliably reduced in coherence by the light scattering material 4 provided at the output ends of the optical fibers 2*d*, to thereby prevent light having high coherence from leaking to the outside.

Seventh Embodiment

Figure 13:
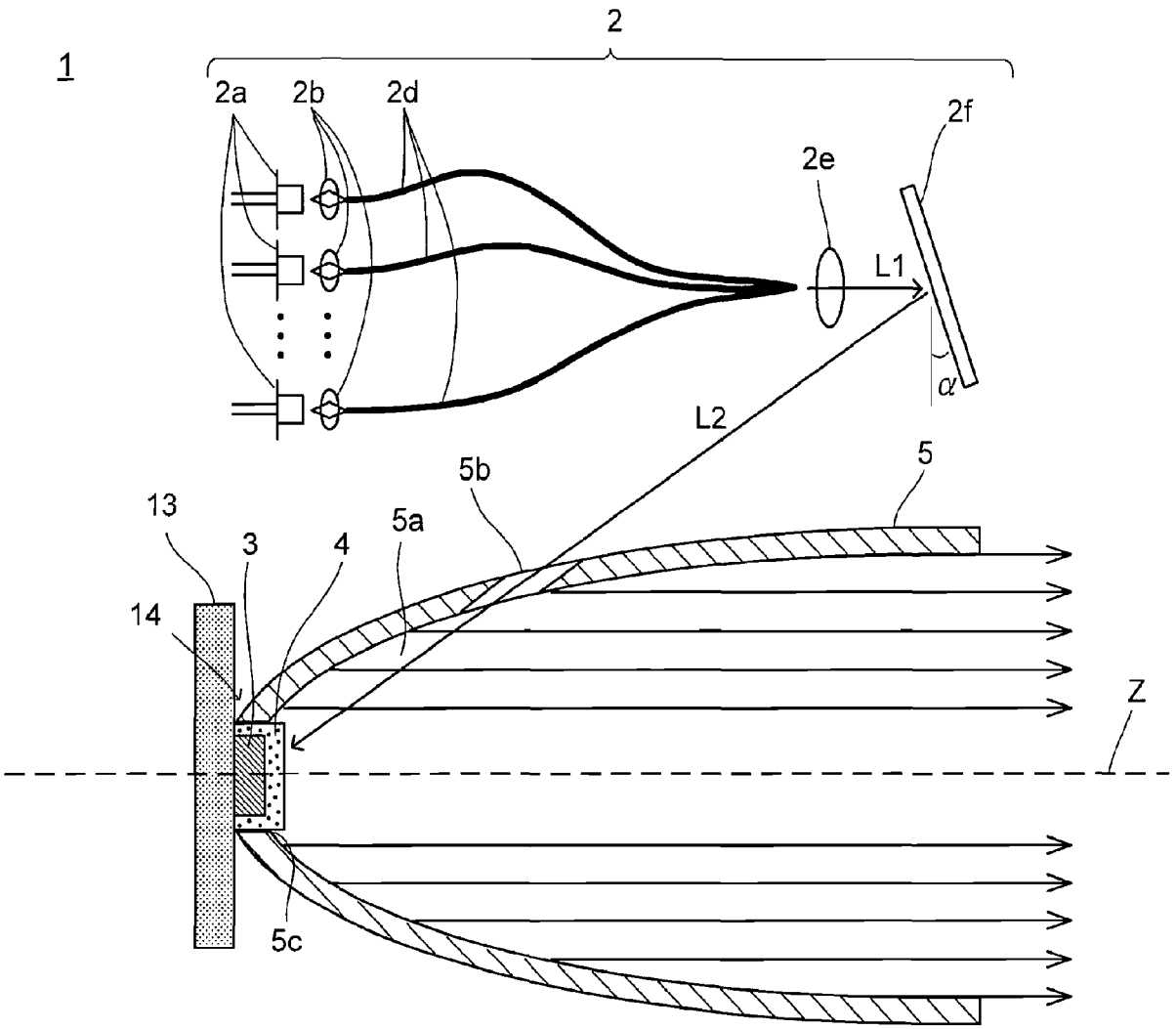
FIG. 13 is a side cross-sectional view schematically illustrating structure of an illumination device according to a seventh embodiment of the present invention.
Figure 14:
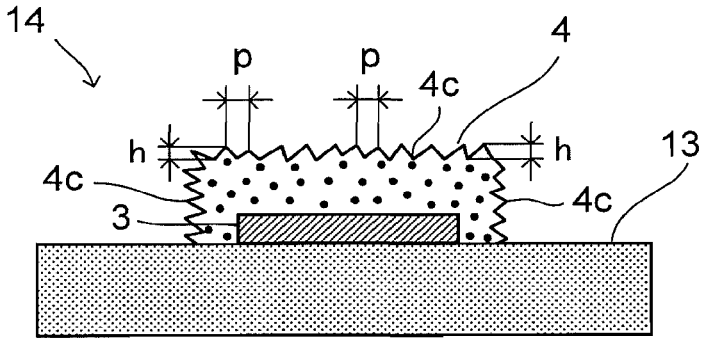
FIG. 14 is a side cross-sectional view illustrating a fluorescent substance unit of the illumination device according to the seventh embodiment.

Next, referring to FIGS. 13 to 16, a seventh embodiment of the present invention is described. FIG. 13 is a side cross-sectional view schematically illustrating structure of an illumination device according to the seventh embodiment. FIG. 14 is a side cross-sectional view illustrating a fluorescent substance unit included in the illumination device of the seventh embodiment. In the illumination device according to this embodiment, components similar to those of the illumination device according to the fifth embodiment illustrated in FIGS. 7 to 9 are denoted by the same reference symbols, and their detailed descriptions are omitted.

In this embodiment, as illustrated in FIG. 13, a parabolic mirror having a deep concave part 5*a* is used as the reflecting mirror 5. The parabolic mirror having the deep concave part 5*a* has a feature that the focal point is closer to the vertex. This feature provides a merit that the parallel rays may be extracted efficiently even when the fluorescent substance 3 is positioned near the vertex of the reflecting mirror 5. In particular, when the fluorescent substance 3 is positioned at the vertex of the reflecting mirror 5, the fluorescent substance 3 may be held by the reflecting mirror 5 itself, with the result that a separate holding member is not needed and an unnecessary shadow is not cast in the concave part 5*a*.

Another feature is that the reflecting surface rises steeply from the vertex. This feature provides a merit that the outer shape of the reflecting mirror 5 may be elongated. The elongated reflecting mirror 5 has a slope of the side surface portion that is nearly parallel to the center axis Z, and hence is useful in allowing the laser light entering from the outside of the side surface to the vertex at an acute incident angle. This way, in contrast to the first to sixth embodiments in which the through holes 5*b* passing through the reflecting mirror 5 are formed behind the fluorescent substance 3 (see FIGS. 1, 2, 3, 5, 7, and 10), in this embodiment, as illustrated in FIG. 13, the through holes 5*b* may be formed in front of the fluorescent substance 3.

A circular mounting hole 5*c* is opened at and around the vertex of the reflecting mirror 5, and a fluorescent substance unit 14 to be described below, which is obtained by integrating the fluorescent substance 3 and the light scattering material 4 on a metal plate 13, is mounted to the mounting hole 5*c* as illustrated in the drawings.

In the illumination device 1 according to this embodiment, the laser irradiation device 2 placed outside the reflecting mirror 5 includes a plurality of (for example, ten) semiconductor laser elements (light sources) 2*a* for emitting laser light, a plurality of collimator lenses 2*b* provided in correspondence with the semiconductor laser elements 2*a*, for converting the laser light emitted from the semiconductor laser elements 2*a* into parallel rays, a plurality of optical fibers 2*d* provided in correspondence with the semiconductor laser elements 2*a* and the collimator lenses 2*b*, for guiding and emitting the laser light converted into the parallel rays, a condenser lens 2*e* for collecting a plurality of laser light beams emitted from the plurality of optical fibers 2*d* into the parallel rays, and a reflector 2*f* for reflecting the collected light. When the semiconductor laser elements 2*a* directly emit satisfactory parallel rays, the collimator lenses 2*b* are not necessarily provided.

The condenser lens 2*e* is placed at a right angle to an optical axis L1 of the laser light emitted from the output ends of the bundled optical fibers 2*d*. The reflector 2*f* is positioned in front with respect to the through holes 5*b* in the reflecting mirror 5. The inclination (denoted by the reference symbol a in FIG. 13) of the reflector 2*f* from the vertical axis is set so that an optical axis L2 of the reflected laser light passes through the through holes 5*b* in the reflecting mirror 5 to be directed toward the vertex of the reflecting mirror 5.

The fluorescent substance 3 is fixed on the metal plate 13, and the light scattering material 4 is formed as a layer to cover the surface of the fluorescent substance 3. In this embodiment, such structure that the fluorescent substance 3 and the light scattering material 4 are integrally provided on the metal plate 13 is referred to as the fluorescent substance unit (denoted by the symbol 14).

Next, a configuration of the fluorescent substance unit 14 is specifically described with reference to FIG. 14.

As the material of the metal plate 13, a metal having good thermal conductivity, such as copper or aluminum, may be suitably used. The metal plate 13 may adopt any planar shape such as a circle or a rectangle and its thickness is not specifically limited. However, the metal plate 13 needs to have certain area and thickness because the metal plate 13 has a function of conducting heat generated from the fluorescent substance 3 and dissipating the heat into the air. Further, it is preferred to enhance the reflectivity of (for example, mirror finish) the surface of the metal plate 13 on which the fluorescent substance 3 is placed, so that the fluorescent light emitted from the fluorescent substance 3 to the metal plate 13 may be reflected and reused.

As the material of the fluorescent substance 3, a transparent resin in which powders of the above-mentioned fluorescent material are dispersed uniformly may be suitably used. The transparent resin may suitably be a UV-curable adhesive. The ratio by weight of the fluorescent material to the transparent resin is, for example, 30%. In this embodiment, the adhesive in which the powders of the fluorescent material are mixed is applied on the metal plate 13 and cured. The fluorescent substance is, for example, 3 mm in diameter and 0.2 mm in thickness. It should be noted that the fluorescent substance 3 may adopt any outer shape such as a cylinder or a cone. However, in this embodiment, it is desired to adopt a shape at least having a surface to be used as a fixing surface, because the fluorescent substance 3 needs to be fixed on the metal plate 13.

The light scattering material 4 may suitably be the glass base material in which titanium oxide particles having a diameter of 1 to 50 μm are dispersed uniformly as the light scattering particles in a ratio by weight of 30%. The light scattering material 4 is placed as a layer on the entire surface (in the case of the shape of a cylinder, upper surface and side surface) of the fluorescent substance 3. The thickness of the layer of the light scattering material 4 is set to, for example, 0.5 mm.

In this embodiment, as illustrated in FIG. 13, the laser light enters from the outside of the light scattering material 4 formed as a layer on the surface of the fluorescent substance 3 toward the fluorescent substance 3 to excite the fluorescent substance 3, which emits fluorescent light to be extracted from the surface of the light scattering material 4. Therefore, the surface of the light scattering material 4 is ideally non-reflective to the laser light and the fluorescent light. Accordingly, as illustrated in FIG. 14, minute projections and recesses 4*c* for reducing the surface reflection are formed on the entire surface of the light scattering material 4.

The sizes of the projections and recesses 4*c* need to be set so that both the distance between any two adjacent projections in a plane (distance between two adjacent recesses)

(hereinafter, referred to as "interval of projections and recesses" and denoted by the reference symbol p in FIG. 14) and the height of the projections (depth of recesses) (denoted by the reference symbol h in FIG. 14) are smaller than the wavelengths of the laser light and the fluorescent light. By forming such structure of projections and recesses having sizes smaller than the wavelength on the surface of the light scattering material 4, the change in refraction index between media inside and outside the light scattering material (in this embodiment, glass and air, respectively) at the surface of the light scattering material 4 may be adjusted to be a mild change, with the result that the surface reflection hardly occurs.

In this embodiment, the interval (p) of projections and recesses is about 100 nm, and the height (h) of about 150 nm is adopted for the projections. Meanwhile, the spectrum of the laser light has a single strong peak wavelength at 405 nm, and the spectrum of the fluorescent light has a broad wavelength range of 420 nm to 800 nm. Therefore, the above-mentioned examples of the sizes of the projections and recesses 4*c* are small enough with respect to the wavelengths of the laser light and the fluorescent light.

The projections and recesses 4*c* may be formed at regular intervals (with uniform dimensions of p and h of FIG. 14) or formed randomly (with non-uniform dimensions of p and h of FIG. 14). With the interval of projections and recesses being very small, it is easier to realize the structure having the desired characteristic of being non-reflective to the laser light and the fluorescent light when the projections and recesses are formed at regular intervals than when the projections and recesses are formed randomly.

Various methods may be used for producing such fluorescent substance unit 14, and the following method may be adopted as an example. Specifically, the UV-curable adhesive in which the powders of the fluorescent material are mixed is applied on the metal plate 13 so as to form a desired shape (in this embodiment, cylinder). Then, the UV-curable resin is irradiated with ultraviolet ray to be cured. With this method, it is easy to form the structure in which the fluorescent substance 3 having the desired shape is fixed on the metal plate 13. Then, low-melting glass powders and titanium oxide powders are put on the exposed surface of the fluorescent substance 3 and heated to 600° C. to melt the glass, and the heating is stopped when the flow of the glass spreads over the entire surface so as to allow the glass to solidify. With this method, it is easy to form the structure in which the light scattering material 4 is formed as a layer on the surface of the fluorescent substance 3.

The fluorescent substance unit 14 constructed as described above is fixed to the reflecting mirror 5 so that, as illustrated in FIG. 13, the portion of the fluorescent substance is inserted in the mounting hole 5*c* from behind the reflecting mirror 5 and the surface of the metal plate 13 is arranged to be substantially orthogonal to the center axis Z of the reflecting mirror 5. The fluorescent substance unit 14 may be fixed to the reflecting mirror 5 by fitting or attaching with an adhesive the portion of the fluorescent substance to the mounting hole 5*c*, or by fixing the portion of the metal plate to the outer surface portion of the reflecting mirror 5 by using a fixing member such as a screw.

In this embodiment, as in the fifth and sixth embodiments (see FIGS. 7 and 10), the laser light excites the fluorescent substance 3 after being transmitted through the light scattering material 4.

Figure 15A:
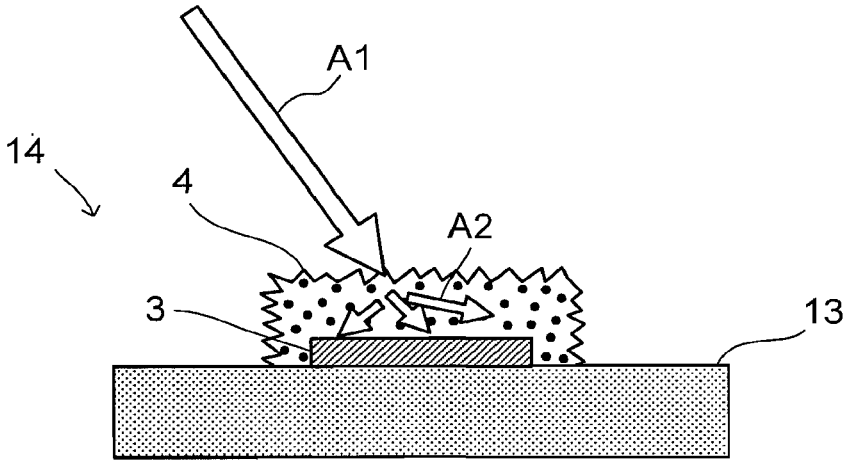
FIG. 15A is a side cross-sectional view of the fluorescent substance unit, illustrating an effect of the light scattering material on light for exciting a fluorescent substance.
Figure 15B:
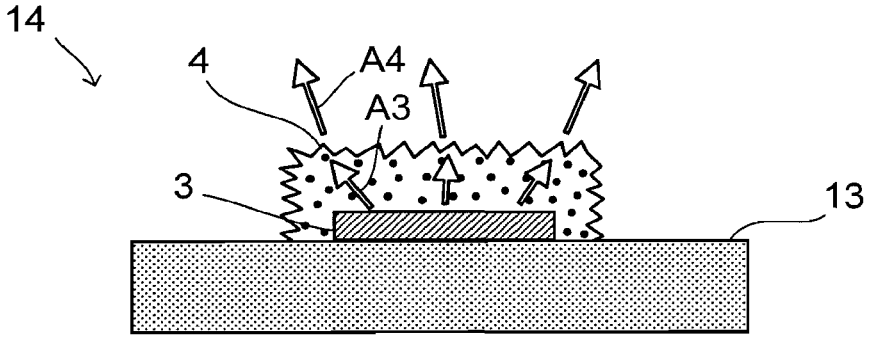
FIG. 15B is a side cross-sectional view of the fluorescent substance unit, illustrating an effect of the light scattering material on light emitted from the fluorescent substance.
Figure 16:
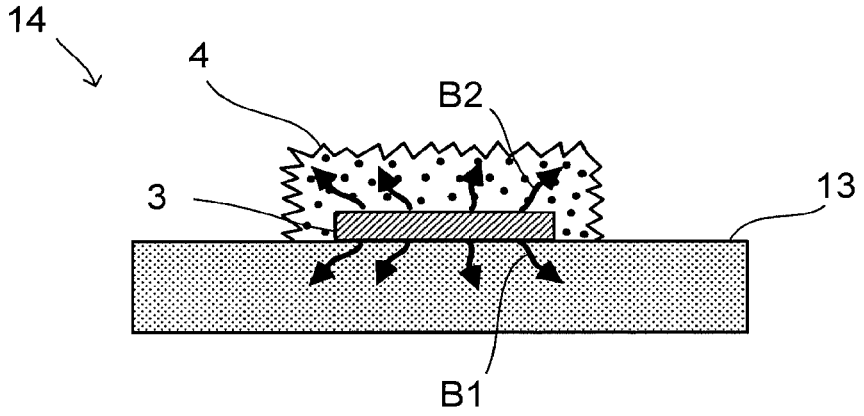
FIG. 16 is a side cross-sectional view of the fluorescent substance unit, illustrating an effect of a metal plate and the light scattering material on heat generated from the fluorescent substance.

Next, referring to FIGS. 15A and 15B and 16, effects of the fluorescent substance unit 14 are described. FIG. 15A is a side cross-sectional view of the fluorescent substance unit of this embodiment, illustrating an effect of the light scattering material on the light for exciting the fluorescent substance (hereinafter, sometimes also referred to as "excitation light"), and FIG. 15B is a side cross-sectional view illustrating an effect of the light scattering material on the light emitted from the fluorescent substance (hereinafter, sometimes also referred to as "fluorescent light"). FIG. 16 is a side cross-sectional view of the fluorescent substance unit of this embodiment, illustrating an effect of the metal plate and the light scattering material on heat generated from the fluorescent substance.

As illustrated in FIG. 15A by the arrow A1, the laser light (in this embodiment, blue-violet laser light having a wavelength of 405 nm) is adjusted in direction so that its optical axis hits substantially the center of the upper surface of the fluorescent substance 3. With the light scattering material 4 being formed as a layer on the surface of the fluorescent substance 3, the laser light does not directly enter the fluorescent substance 3, but enters inside from the surface of the light scattering material 4. In this case, with the projections and recesses 4*c*, which have sizes smaller than the wavelength of the laser light (that is, dimensions of p and h of FIG. 14 smaller than the wavelength of the laser light), being provided on the surface of the light scattering material 4, the laser light is hardly reflected on the surface of the light scattering material 4 (reflectivity: less than 0.1%) and enters inside the light scattering material 4 substantially in its entirety.

After entering inside the light scattering material 4, the laser light is scattered by scattering particles in the light scattering material 4 as illustrated in FIG. 15A by the arrows A2, and then enters the fluorescent substance 3. In this case, with the light scattering particles (titanium oxide particles), which have sizes larger than the wavelength, being dispersed in the light scattering material 4, the laser light entering inside the light scattering material 4 is multiple scattered. This reduces coherence of the laser light. This scattered excitation light is reduced in coherence but maintains the wavelength of the original laser light. Therefore, the excitation light enters the fluorescent substance 3 to excite the fluorescent material in the fluorescent substance 3.

The fluorescent substance 3 is excited by the laser light to emit white fluorescent light. At this time, as illustrated in FIG. 15B, the white fluorescent light is multiple scattered by the light scattering particles in the light scattering material 4 as in the case of the excitation light. The scattered fluorescent light reaches the surface of the light scattering material 4 provided on the upper surface and the side surface of the fluorescent substance 3. The fluorescent light traveling to the bottom surface of the fluorescent substance 3 is reflected for the most part by the metal plate 13 and also reaches the surface of the light scattering material 4. In this case, with the projections and recesses 4*c*, which have sizes smaller than the wavelength of the laser light (that is, dimensions of p and h of FIG. 14 smaller than the wavelength of the laser light), being provided on the surface of the light scattering material 4, the fluorescent light is hardly reflected on the surface of the light scattering material 4 (reflectivity: less than 0.1%) and emitted outside the light scattering material 4 substantially in its entirety. The emitted fluorescent light is reflected by the reflecting mirror 5 (see FIG. 13) to be projected forward as parallel rays.

Meanwhile, the excited fluorescent substance 3 generates heat of very high density. Especially when the illumination device 1 is to attain high luminance, the fluorescent substance 3 needs to be small enough to be regarded as a point light source. In this case, however, the small fluorescent substance 3 may reach the temperature of several hundred degrees Celsius, and hence heat dissipation structure for efficiently dissipating the heat of the fluorescent substance 3 is required.

In this embodiment, as illustrated in FIG. 16, the bottom surface of the fluorescent substance 3 is in thermal contact with the metal plate 13 having good thermal conductivity. Therefore, the heat of the fluorescent substance 3 is conducted to the metal plate 13 as illustrated in FIG. 16 by the arrows B1 to be efficiently dissipated from the surface of the metal plate 13 into the air. Further, the thermal conductivity of the light scattering material 4 covering the surface of the fluorescent substance 3 is higher than air, if not higher than a metal. Therefore, as illustrated by the arrows B2, a part of the heat of the fluorescent substance 3 is also conducted to the light scattering material 4 to be dissipated through the light scattering material 4. In other words, the light scattering material 4 contributes to the heat dissipation of the fluorescent substance 3. The fluorescent substance 3 is formed to be thin enough to avoid accumulating heat therein, and hence it is possible to efficiently conduct heat from the surface of the fluorescent substance 3 to the metal plate 13 and the light scattering material 4.

According to the illumination device of this embodiment, the laser light enters the light scattering material 4 having the minute projections and recesses 4*c* before exciting the fluorescent substance 3. Therefore, in addition to the effect of reducing coherence by the scattering effect of the light scattering particles in the light scattering material 4 described above in the first to sixth embodiments, the laser light that is reflected at the surface of the light scattering material 4 may be suppressed. Consequently, the leakage of the laser light is reliably prevented to significantly increase the safety to the eye. As illustrated in FIG. 13, the laser light enters obliquely with respect to the center axis Z. However, with the light scattering material 4, which has the size apparently larger than the fluorescent substance 3, covering the fluorescent substance 3, even when the laser irradiation device 2 becomes out of alignment and the optical axis L2 of the laser light is displaced to some extent, the possibility that the laser light is directly reflected by the reflecting mirror 5 to exit as it is to the outside is small.

Further, according to the illumination device of this embodiment, heat generated from the fluorescent substance 3 is positively dissipated by using the metal plate 13. Therefore, deterioration over time or a burn of the fluorescent substance 3 may be suppressed. In addition, the metal plate 13 is exposed to the space outside the reflecting mirror 5 to avoid accumulating heat in the concave part 5*a*, which is suitable in the case where the reflecting mirror 5 having the deep concave part 5*a* as illustrated in FIG. 13 is used.

Further, according to the illumination device of this embodiment which uses the fluorescent substance unit 14 in which the fluorescent substance 3 is integrated with the light scattering material 4 on the metal plate 13, the convenience in handling the light scattering material 4 is increased. In addition, the parts may be disintegrated in units to save the time and effort in exchanging the parts.

Eighth Embodiment

Figure 17:
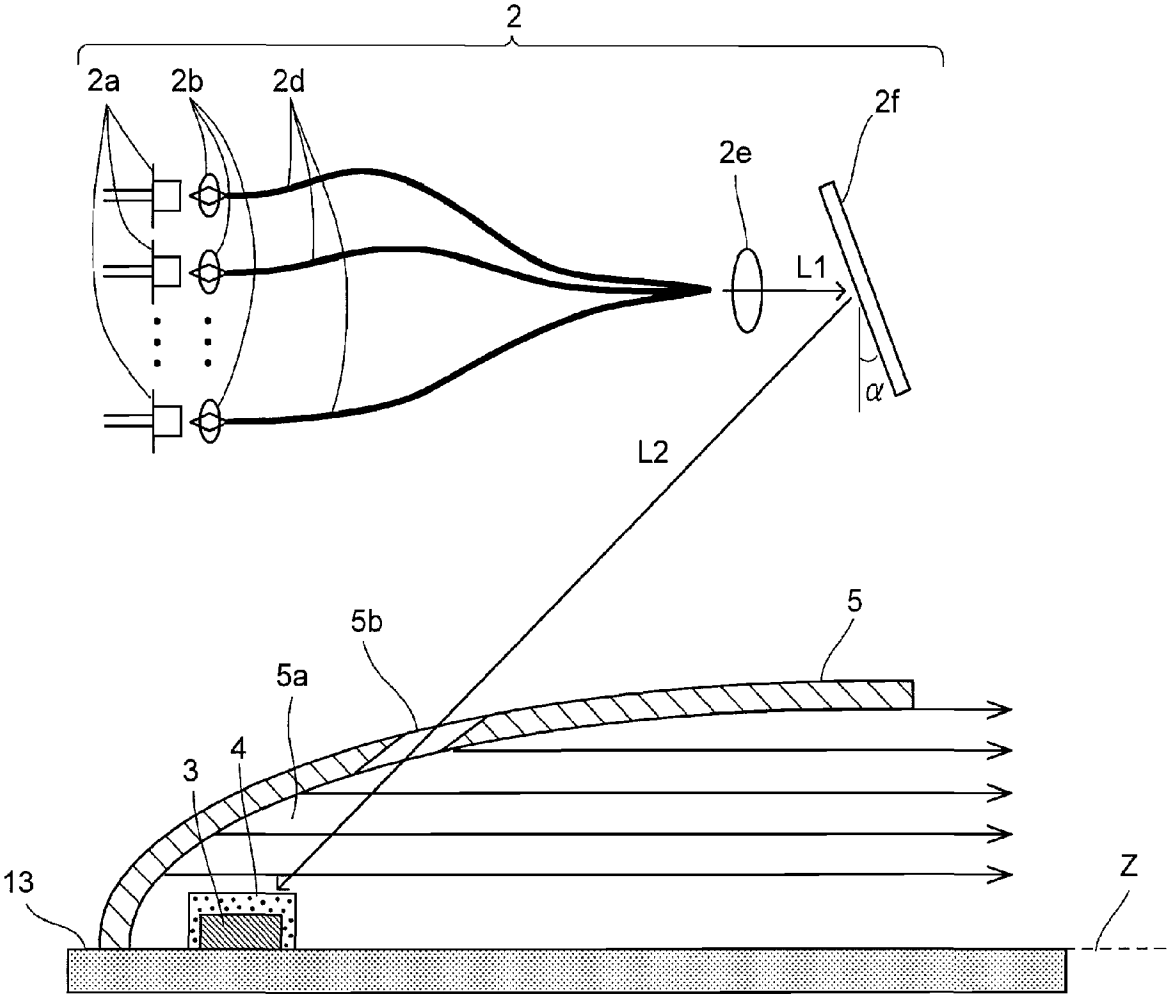
FIG. 17 is a side cross-sectional view schematically illustrating structure of an illumination device according to an eighth embodiment of the present invention.

Next, referring to FIG. 17, an eighth embodiment of the present invention is described. FIG. 17 is a side cross-sectional view schematically illustrating structure of an illumination device according to the eighth embodiment. In the illumination device according to this embodiment, components similar to those of the illumination device according to the seventh embodiment illustrated in FIG. 16 are denoted by the same reference symbols, and their detailed descriptions are omitted.

In this embodiment, as illustrated in FIG. 17, a half reflector having a shape obtained by dividing the parabolic mirror (see FIG. 13) in half in a plane passing through the center axis Z. The half reflector has a half area of the reflecting surface. However, when the reflecting mirror 5 is supported by a plate-shaped supporter having a plane passing through the center axis Z (see metal plate 13 of FIG. 17), the focal point is located on the supporter. Therefore, it is easy to support the fluorescent substance 3 at the focal point without using a separate holding member. In this embodiment, the metal plate 13 constituting the fluorescent substance unit 14 is used as the supporter.

According to the illumination device of this embodiment, the fluorescent substance 3 may be placed at the focal point of the reflecting mirror 5, to thereby improve the utilization efficiency of the parallel rays. This is effective in producing beam-shaped light that travels over a long distance as a small light flux without diverging, especially in the parabolic mirror having the deep concave part 5*a*.

Further, according to the illumination device of this embodiment, the metal plate 13 constituting the fluorescent substance unit 14 may have a large surface area without increasing the size of the device, to thereby improve the heat dissipation efficiency of the fluorescent substance 3.

Hereinabove, the illumination device according to the present invention has been described with reference to the specific embodiments. However, the present invention is not dependent on the type of the semiconductor laser elements, the wavelength, the output, the type of the fluorescent substance, the wavelength of the fluorescent light, or the way the laser light is guided to the fluorescent substance.

For example, in the embodiments described above, a case where the plurality of semiconductor laser elements having the same intrinsic wavelength are uniformly used. However, semiconductor laser elements having different intrinsic wavelengths may be used in combination to realize required tone of the illumination light. In an example, two kinds of intrinsic wavelengths of 405 nm (blue-violet) and 650 nm (red) may be used for the semiconductor laser elements, and SiAlON (blue-green) is used for the fluorescent substance. In this case, the laser light having the wavelength of 405 nm excites the SiAlON fluorescent substance to emit blue-green light, and weak red is supplemented with the semiconductor laser element that emits light having the wavelength of 650 nm.

What is claimed is:

1. An illumination device for exciting a fluorescent substance by irradiating the fluorescent substance with laser light from a laser irradiation device to emit visible light for use as illumination light, comprising:

a light scattering material; and a light projecting member for projecting fluorescent light emitted from the fluorescent substance, wherein the fluorescent substance and the light scattering material are arranged in this order on an optical axis of the laser light so that the fluorescent substance is away from the light scattering material, the light scattering material covers and is attached to part of the light projecting member, and the light scattering material includes light scattering particles or surface irregularities and allows the laser light and the light from the fluorescent substance to pass through the light scattering material and the light projection member, while scattering the lights by the scattering particles or surface irregularities.

2. An illumination device according to claim 1, wherein the laser irradiation device comprises a plurality of semiconductor laser elements for emitting the laser light, and a condenser member for collecting the laser light emitted from the plurality of semiconductor laser elements onto the fluorescent substance.

3. An illumination device according to claim 1, wherein the laser irradiation device comprises a light source for emitting the laser light, and a light guiding member for guiding the laser light emitted from the light source to the fluorescent substance.

4. An illumination device according to claim 1, wherein the fluorescent substance is placed on a metal plate.

5. An illumination device according to claim 1, wherein the light scattering material comprises glass or resin.

6. An illumination device according to claim 1, wherein a surface of the light scattering material has projections and recesses that are smaller in size than a wavelength of the laser light.

7. An illumination device according to claim 1, wherein the light scattering material comprises a fluid in which light scattering particles are dispersed and a transparent container for containing the fluid.

8. An illumination device according to claim 7, further comprising a circulation path of the fluid, and a pump provided midway of the circulation path.

9. An illumination device for exciting a fluorescent substance by irradiating the fluorescent substance with laser light from a laser irradiation device to emit visible light for use as illumination light, comprising:

a light scattering material;

a light projecting member for projecting fluorescent light emitted from the fluorescent substance; and a cover for covering an output end of the light projecting member, wherein the fluorescent substance and the light scattering material are arranged in this order on an optical axis of the laser light so that the fluorescent substance is away from the light scattering material, the light scattering material covers and is attached to part of the cover, and the light scattering material includes light scattering particles or surface irregularities and allows the laser light and the light from the fluorescent substance to pass through the light scattering material, while scattering the lights by the scattering particles or surface irregularities.

10. An illumination device according to claim 9, wherein the laser irradiation device comprises a plurality of semiconductor laser elements for emitting the laser light, and a condenser member for collecting the laser light emitted from the plurality of semiconductor laser elements onto the fluorescent substance.

11. An illumination device according to claim 9, wherein the laser irradiation device comprises a light source for emitting the laser light, and a light guiding member for guiding the laser light emitted from the light source to the fluorescent substance.

12. An illumination device according to claim 9, wherein the fluorescent substance is placed on a metal plate.

13. An illumination device according to claim 9, wherein the light scattering material comprises glass or resin in which light scattering particles are dispersed.

14. An illumination device according to claim 9, wherein a surface of the light scattering material has projections and recesses that are smaller in size than a wavelength of the laser light.

15. An illumination device according to claim 9, wherein the light scattering material comprises a fluid in which light scattering particles are dispersed and a transparent container for containing the fluid.

16. An illumination device according to claim 15, further comprising a circulation path of the fluid, and a pump provided midway of the circulation path.

* * * * *